US008104178B2

(12) United States Patent
Worgull

(10) Patent No.: US 8,104,178 B2
(45) Date of Patent: Jan. 31, 2012

(54) CUTTING HEAD FOR AN ELECTRIC HAIR CUTTING MACHINE

(75) Inventor: Klaus Worgull, Darmstadt (DE)

(73) Assignee: Wella GmbH, Schwalbach am Taunus (DE)

( * ) Notice: Subject to any disclaimer, the term of this patent is extended or adjusted under 35 U.S.C. 154(b) by 165 days.

(21) Appl. No.: 10/581,011

(22) PCT Filed: Dec. 6, 2004

(86) PCT No.: PCT/EP2004/013846

§ 371 (c)(1),
(2), (4) Date: Feb. 15, 2007

(87) PCT Pub. No.: WO2005/053916

PCT Pub. Date: Jun. 16, 2005

(65) Prior Publication Data

US 2007/0289138 A1 Dec. 20, 2007

(30) Foreign Application Priority Data

Dec. 4, 2003 (DE) ..... 103 56 588

(51) Int. Cl.
*B26B 19/06* (2006.01)
*B26B 19/20* (2006.01)

(52) U.S. Cl. ..... 30/43.1; 30/43.92; 30/208; 30/223; 30/346.51

(58) Field of Classification Search ..... 30/43.92, 30/43, 43.1, 43.2, 43.3, 43.7, 43.8, 43.9, 30/43.91, 200, 201, 208, 223, 225, 346.51
See application file for complete search history.

(56) References Cited

U.S. PATENT DOCUMENTS

| | | | | | |
|---|---|---|---|---|---|
| 1,596,241 | A | * | 8/1926 | Donnellon | 30/223 |
| 1,598,737 | A | * | 9/1926 | Marcotte | 30/208 |
| 2,166,605 | A | * | 7/1939 | Muros | 30/43.92 |
| 2,177,440 | A | * | 10/1939 | Muros | 30/43.92 |
| 2,194,465 | A | * | 3/1940 | Bott | 30/43 |
| 2,223,310 | A | * | 11/1940 | Testi | 30/43.2 |
| 2,236,760 | A | * | 4/1941 | Muros et al. | 30/43.92 |
| 2,239,931 | A | * | 4/1941 | Prescott | 310/29 |
| 2,240,633 | A | * | 5/1941 | Testi | 30/43.2 |
| 2,253,195 | A | * | 8/1941 | Oster | 30/43.92 |
| 2,265,383 | A | * | 12/1941 | Martin | 30/208 |
| 2,283,552 | A | * | 5/1942 | Hanley | 310/29 |
| 2,448,219 | A | * | 8/1948 | Hirsch | 30/43.92 |
| 2,948,063 | A | | 8/1960 | Jepson | |
| 4,557,050 | A | * | 12/1985 | Haraguchi et al. | 30/195 |
| 4,825,546 | A | * | 5/1989 | Araki et al. | 30/201 |
| 4,951,394 | A | * | 8/1990 | Meijer | 30/223 |
| 6,889,437 | B2 | * | 5/2005 | Bader et al. | 30/43.1 |

FOREIGN PATENT DOCUMENTS

| | | |
|---|---|---|
| EP | 0 282 117 | 9/1988 |
| EP | 0 856 386 | 8/1998 |

* cited by examiner

*Primary Examiner* — Clark F. Dexter
(74) *Attorney, Agent, or Firm* — Michael J. Striker

(57) ABSTRACT

The invention relates to a cutting head (1), comprising a lower and an upper shears blade (2, 3), for an electric hair cutting machine (4). The lower shears blade and the upper shear blade (2, 3) are connected to each other, whereby a cutting blade (5), made from a planar material (7), is driven in oscillation in a slot (31) between the lower and the upper shears blade (2, 3) and is provided with cutting teeth (6).

8 Claims, 9 Drawing Sheets

CUTTING HEAD FOR AN ELECTRIC HAIR CUTTING MACHINE

CROSS-REFERENCE TO RELATED APPLICATIONS

This application is the National Stage Entry of PCT/EP04/13846, filed Dec. 6, 2004 and claims priority under 35 U.S.C. 119(a)-(d) to German Patent Application DE 103 56 588.4, filed Dec. 4, 2003.

BACKGROUND OF THE INVENTION

1. Field of the Invention

The invention relates to a cutting head for an electric hair cutting machine.

2. Description of Related Art

A cutting head for an electric hair cutting machine, forming this generic type, is known for instance from European Patent Disclosure EP0856386B1. In it, in the cutting head, an upper shearing blade is driven oscillatingly by back and forth motions by an electric motor and an eccentric, and cutting of the hair is done between a fixed lower shearing blade and the movable upper shearing blade. For cutting the hair, it is important that the cutting edges between the two blades are sharp, and that as much as possible no gap or play exists between them. Because of the oblique disposition, when hair is being cut between the fixed blade and the movable blade, these blades have a wedging action, which can lead to the gap and thus make the cutting performance substantially worse. To avoid this, the movable upper shearing blade is pressed with strong spring force against the lower shearing blade and is dimensioned correspondingly stably. Because of the stable and thus heavy (massive) embodiment of the movable upper shearing blade and because of the friction resulting from the requisite contact-pressure force, high drive energy is required, which necessitates a relatively heavy drive motor, and in the case of a cordless hair cutting machine a relatively heavy rechargeable battery in addition. Moreover, strong forces of acceleration are transmitted as troublesome vibration to the housing of the hair cutting machine.

BRIEF SUMMARY OF THE INVENTION

The object of the invention is therefore to overcome the above-described disadvantages, in a hair cutting machine of the same generic type.

Further advantageous refinements and features of the invention are disclosed in the dependent claims.

Because in the cutting head with a lower shearing blade and an upper shearing blade for an electric hair cutting machine, it is provided that the lower and upper shearing blades be joined solidly to one another, and an oscillatingly drivable cutting blade, made from a flat material and having a cutting serration, is located in a slit between the lower and upper shearing blades, the aforementioned disadvantages are overcome.

The invention is described in further detail in terms of an exemplary embodiment.

DETAILED DESCRIPTION OF THE INVENTION

Figure 1:
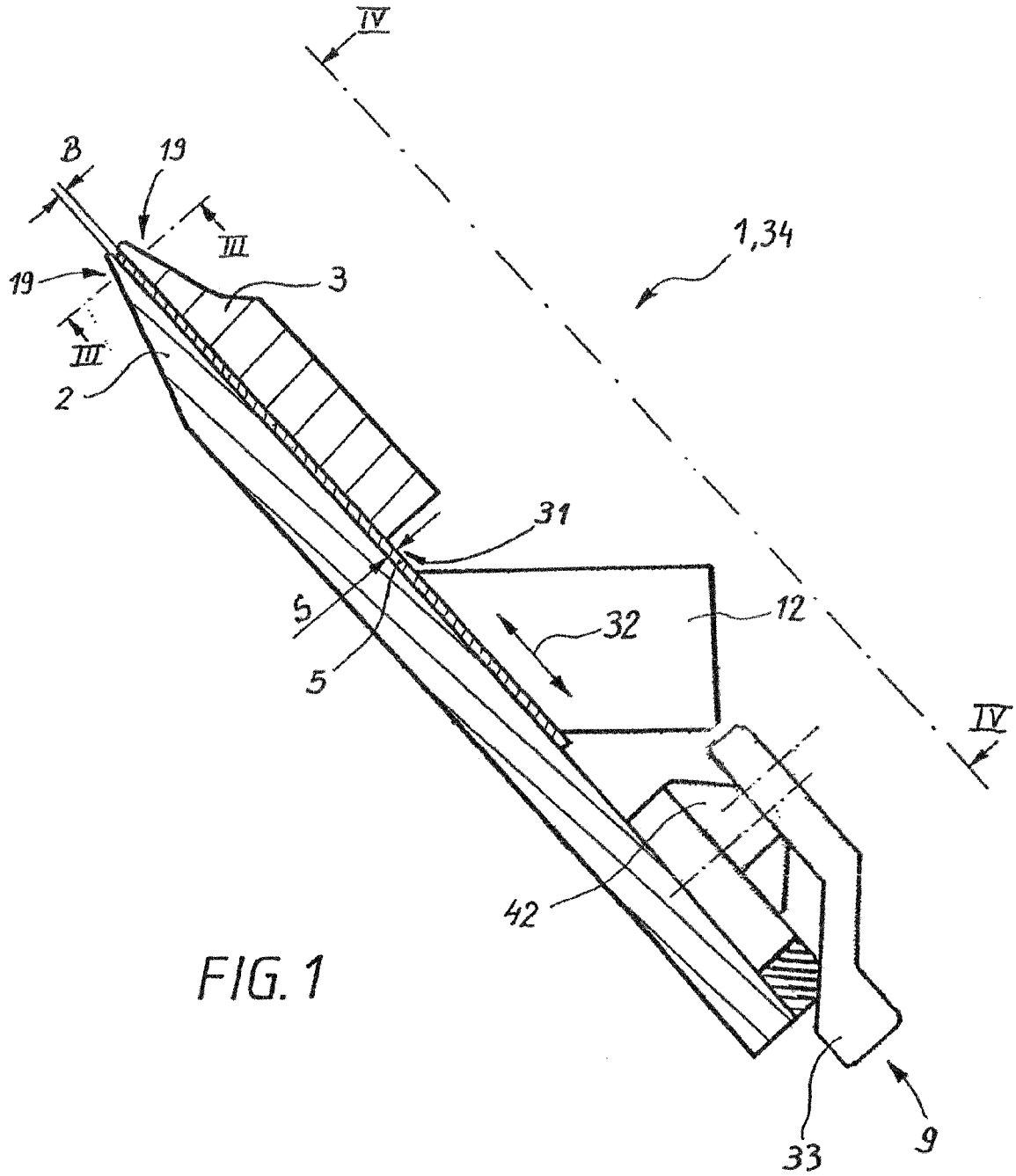
FIG. 1, in a side view, a cutting head, in a section through a lower shearing blade, an upper shearing blade, and a cutting blade.

FIG. 1 shows a cutting head 1 with lower and upper shearing blades 2, 3 for an electric hair cutting machine 4 (FIG. 2), in which the lower and upper shearing blades 2, 3 are solidly joined to one another. Between the lower and upper shearing blades 2, 3, there is a slit 31, in which a cutting blade 5 is received that is made from a flat material 7 and that can be driven to oscillate by a slaving device 12. The cutting blade 5 is provided on its end with a cutting serration 6 (FIG. 8), which corresponds with a shearing blade serration 19 of the lower shearing blade 2 and a shearing blade serration 19 of the upper shearing blade 3.

The cutting blade 5 is made from a thin flat material 7, preferably from a hard metal sheet 7.1, which leads to an extreme reduction in mass and can furthermore be manufactured economically. The cutting blade 5 is preferably provided with a material thickness S of approximately 0.1 to 1.0 mm. Since the low-mass cutting blade 5 is moreover driven without contact-pressure force, substantially less driving energy is necessary, and interfering vibration at the housing 17 of the hair cutting machine 4 is largely suppressed. Because the low-mass cutting blade 5 is moreover driven without contact-pressure force, extremely low friction results, and thus the energy consumption is extremely low. To reduce the weight of the two shearing blades 2, 3, the cutting blade 5 is guided between the two fixed shearing blades 2, 3. The guide width B between the two shearing blades 2, 3 can be adapted precisely to the thickness S of the movable cutting blade 5 with extremely minimal play, making an additional contact-pressure force superfluous.

The cutting head 1 is selectively provided with an integrated hair cutting length adjuster 9, making the shearing blades 2, 3 capable of being displaced manually relative to the cutting blade 5, which is disposed in the slit 31, in the direction of the arrow (arrow 32) via a lever 33. This hair cutting length adjuster 9 is in principle known from the aforementioned EP0856386B1, particularly from FIGS. 1 through 5 thereof along with the corresponding description, but instead of the lower shearing blade, in this case the two shearing blades 2, 3 solidly joined to one another are displaceable/adjustable relative to the cutting blade 5. The cutting head 1 is embodied as a structural unit 34 and is embodied as lockable to the hair cutting machine 4 (FIG. 2).

Figure 2:
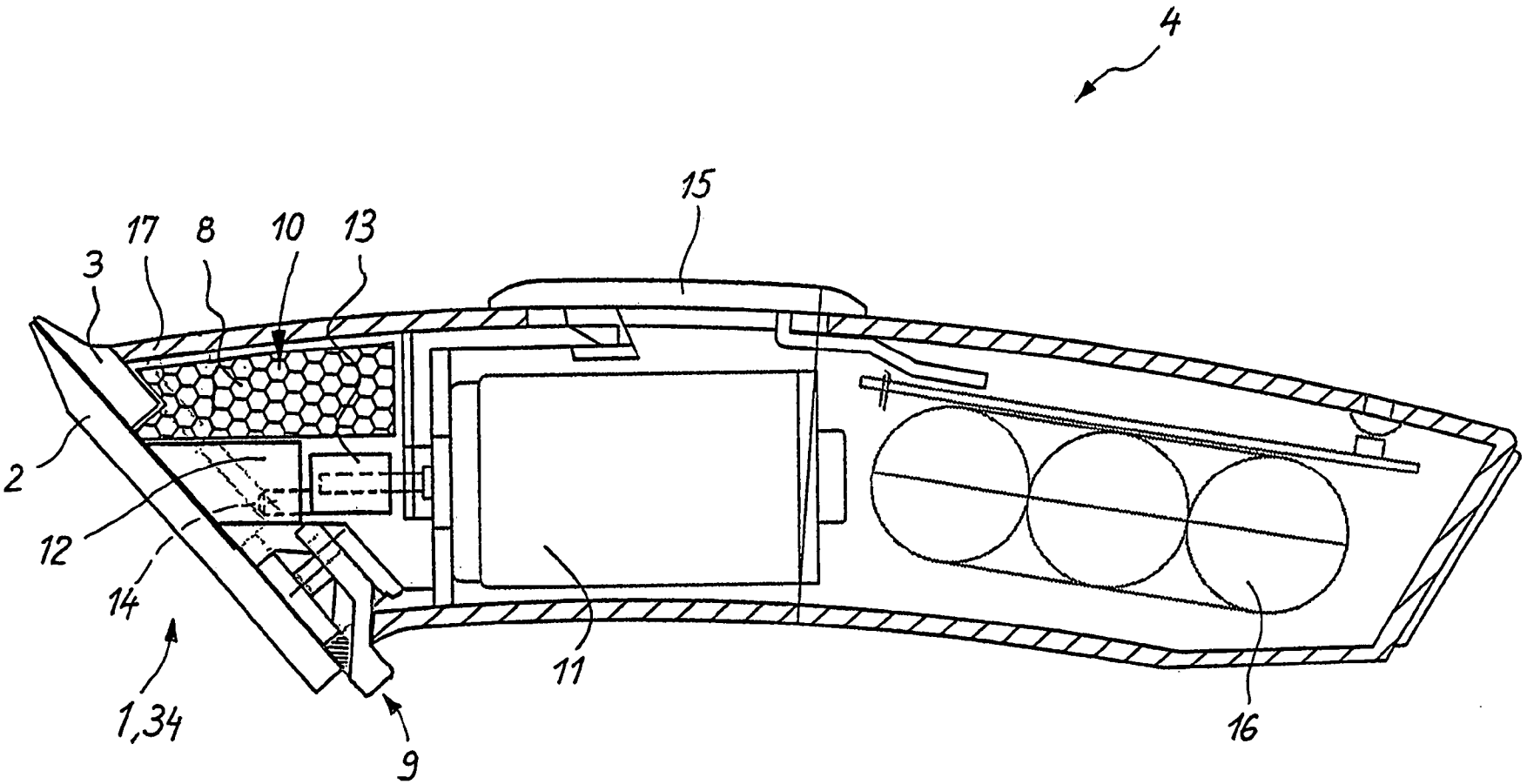
FIG. 2, the cutting head of FIG. 1, which is connected to a hair cutting machine.

FIG. 2 shows a cutting head 1 that is joined to the hair cutting machine 4. The hair cutting machine 4 is provided with a drive motor 11 with an eccentric 13, and an eccentric peg 14 drives the cutting blade 5 via the slaving device 12. The drive motor 11 is connected to a rechargeable battery 16 via a switch 15.

To prevent soiling in an interstice 10 adjacent the drive motor 11 and in the cutting head 1, the cutting head 1 can be constructed as fully encapsulated. Moreover, the interstice 10 can be utilized for a lubricant reservoir 8, thus maximally dispensing with manual refilling.

By means of a closed structural form of the cutting head 1, any kind contact of the movable cutting blade 5 with the scalp of a person is avoided. This makes a further spacing of the cutting blade 5 apart for the housing 17 possible without the risk of injury and makes improved manipulation possible when working with the hair cutting machine 4.

Figure 3:
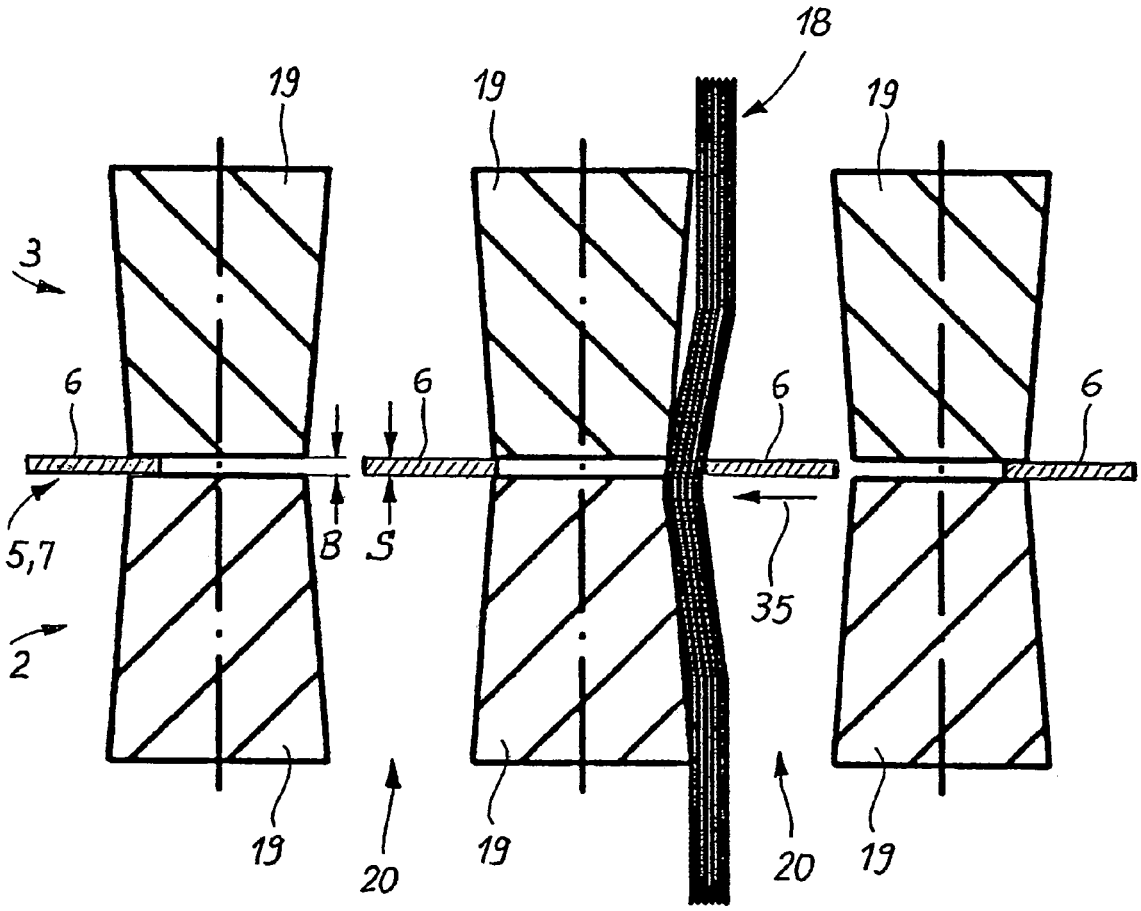
FIG. 3, a sectional view taken along the line III-III in FIG. 1.

FIG. 3 shows the cutting head 1 along the section line III-III in FIG. 1, showing a section through the lower shearing blade 2, upper shearing blade 3, and cutting blade 5. The cutting blade 5 that oscillates back and forth is located between the fixed lower shearing blade 2 and the fixed upper shearing blade 3 and is shown here with its cutting serration 6 in the direction of the arrow (arrow 35) just before cutting a plurality of hairs 18 (shown here only symbolically). The lower shearing blade 2 and the upper shearing blade 3 are provided in a line with an identical, diametrically opposed shearing blade serration 19 at equal spacings and having tooth gaps 20 of equal widths, and the cutting serration 6 of the cutting blade 5 is located at lesser spacings, so that the hair 18 will be cut not simultaneously but in staggered fashion. In practice, a serration ratio of 1.5 (shearing blade serration 19) to 1.3 (cutting serration 6) has proven itself. To prevent the creation of a burr (as would be the case in stamping) in the manufacture of the cutting serration 6, the cutting serration is produced by erosion.

Figure 4:
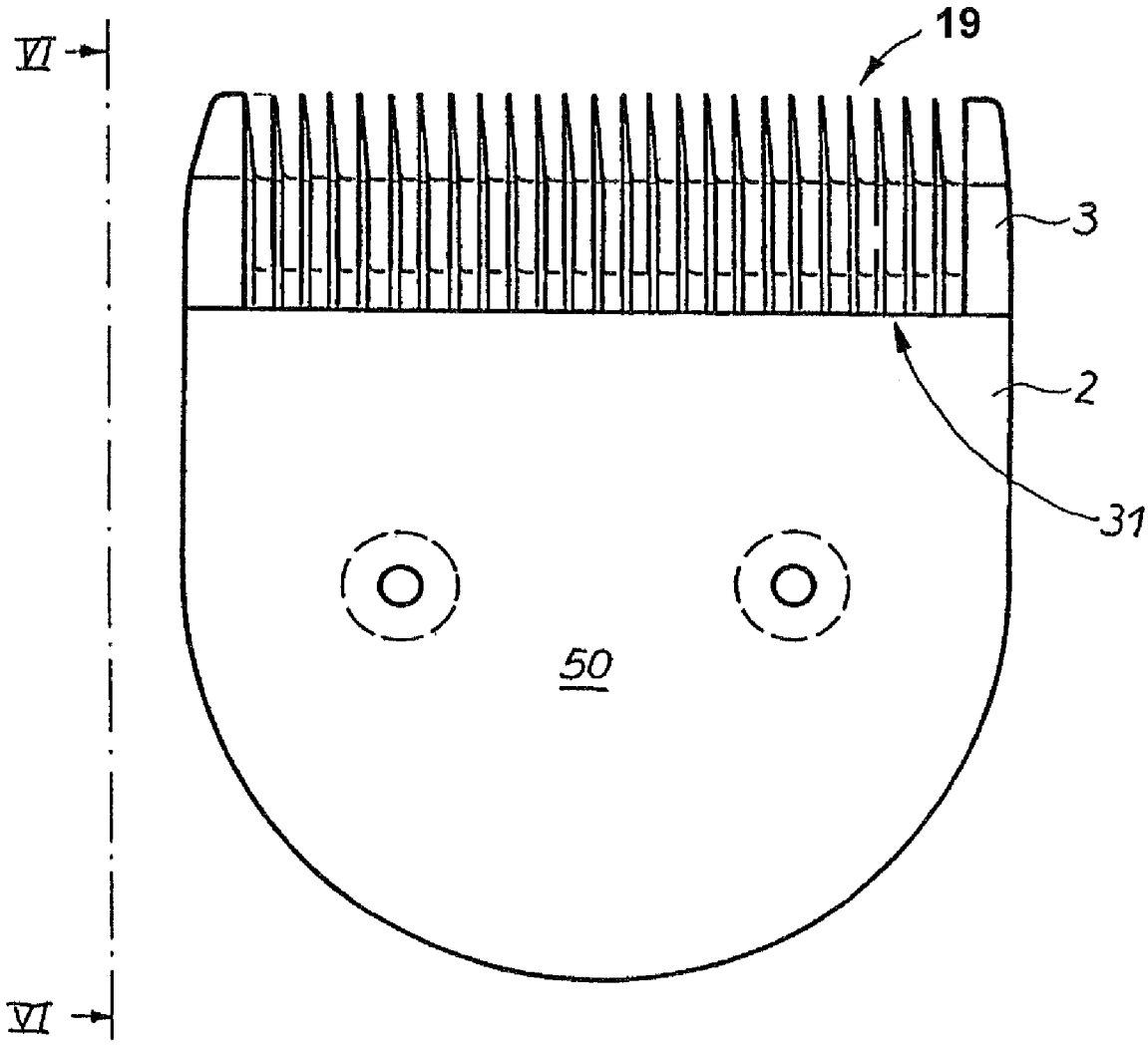
FIG. 4, a top view taken along the line IV-IV in FIG. 1, but without the cutting blade and slaving device, and without a hair cutting length adjuster.

FIG. 4 shows a top view IV-IV on the cutting head 1 of FIG. 1, but without the cutting blade 5, the slaving device, and the hair cutting length adjuster 9.

Figure 5:
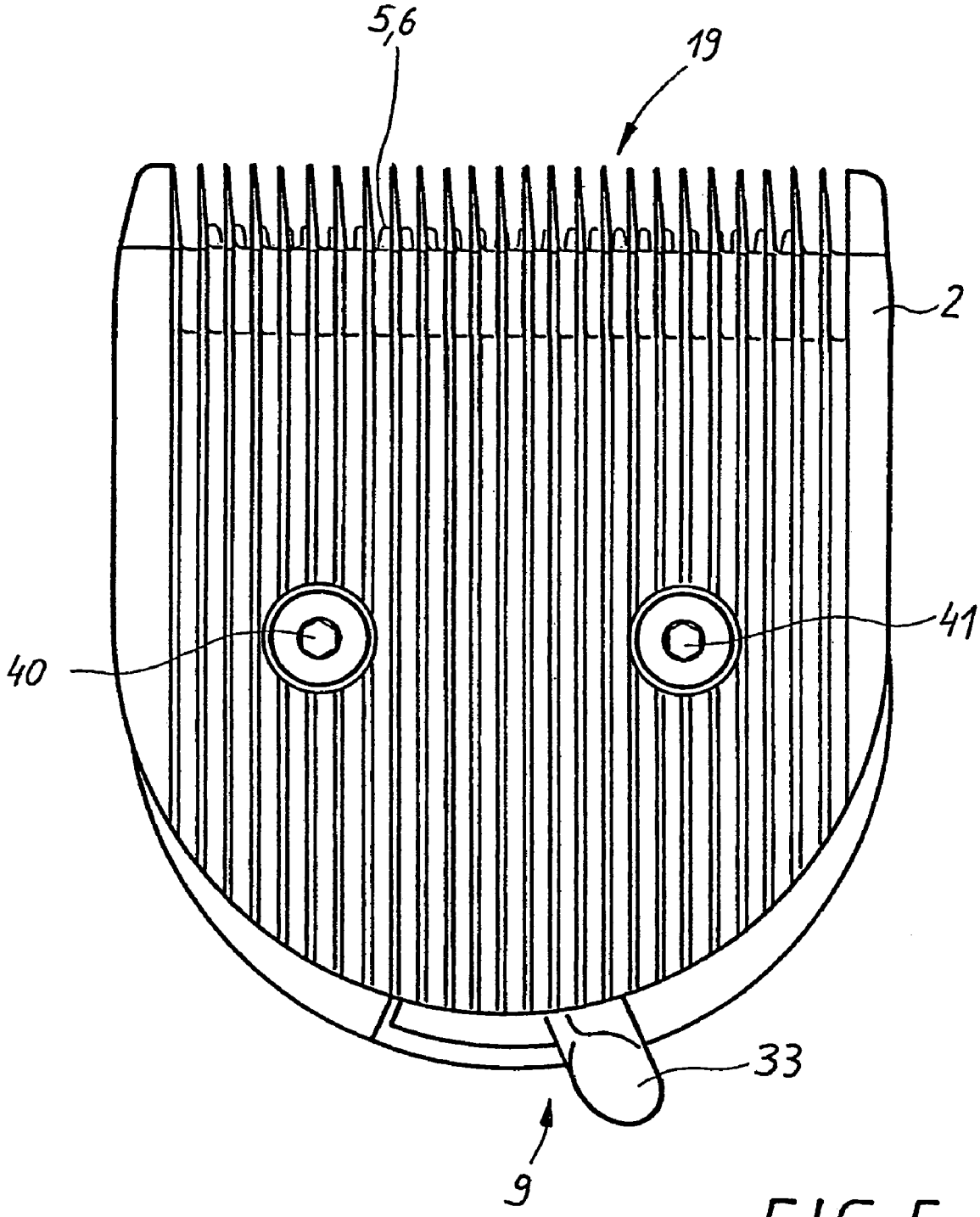
FIG. 5, a plan view on an underside of the cutting head.

FIG. 5 shows a plan view on an underside of the complete cutting head 1 with two fastening screws 40, 41 for fastening a stationary eccentric part 42 (FIG. 1).

Figure 6:
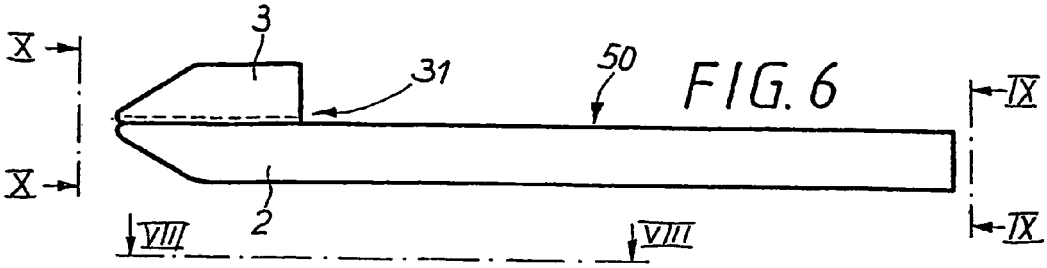
FIG. 6, a side view taken along the line VI-VI of the shearing blade in FIG. 4.

FIG. 6 shows a side view taken along the line VI-VI of the two shearing blades 2, 3 in FIG. 4.

Figure 7:
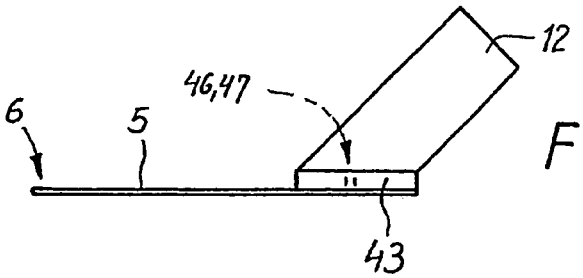
FIG. 7, a side view of the cutting blade with the slaving device.

FIG. 7 shows a side view of the cutting blade 5 with a slaving device 12 and a connecting rail 43, which is solidly connected (for instance glued) to the cutting blade 5.

Figure 8:
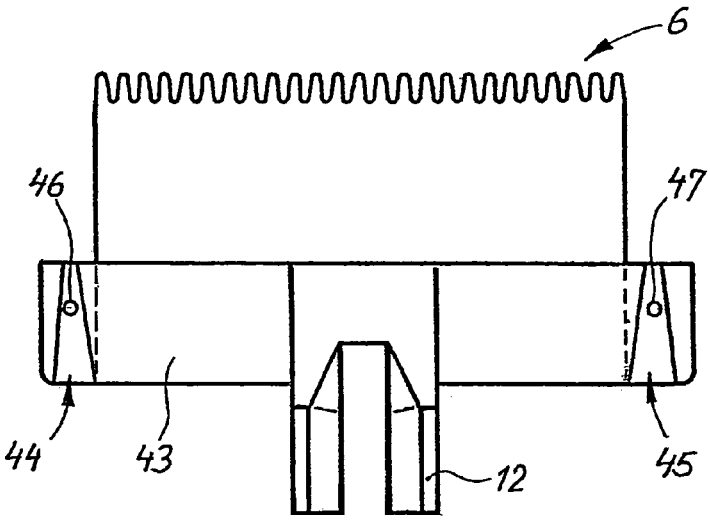
FIG. 8, a plan view VIII-VIII of the cutting blade and slaving device of FIG. 7.

FIG. 8 shows a plan view VIII-VIII on the cutting blade 5 of FIG. 7. On both sides of the connecting rail 43, there is a respective spring leg receptacle 44, 45, each with a respective bore 46, 47 for receiving legs 38, 39 of a spring 37 (FIG. 11).

Figure 9:
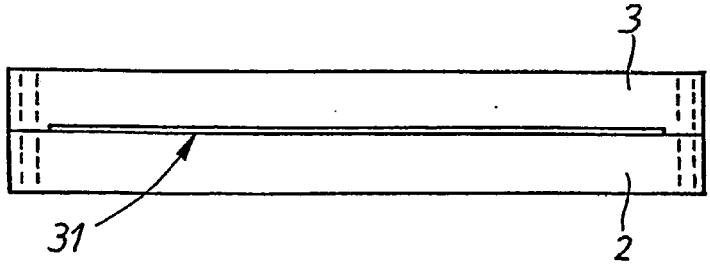
FIG. 9, a side view IX-IX of the shearing blade of FIG. 6.

FIG. 9 shows a side view IX-IX of the shearing blades 2, 3 of FIG. 6; here the slit 31 for receiving the cutting blade 5 is clearly visible. In this exemplary embodiment, the slit 31 is located all the way through; however, it is also possible to provide the slit 31 up to just before the ends of the shearing blade serration 19 and to provide it with a common rounding.

Figure 10:
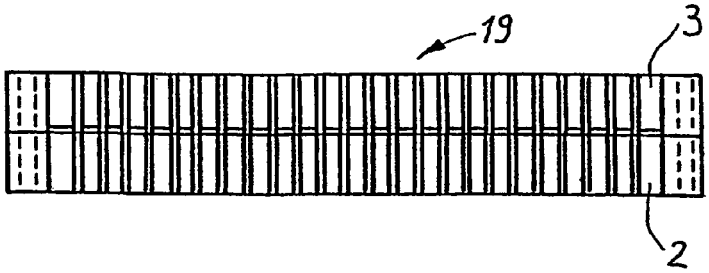
FIG. 10, a side view X-X of the shearing blade of FIG. 6.

FIG. 10 shows a side view X-X of the shearing blades 2, 3 of FIG. 6.

Figure 11:
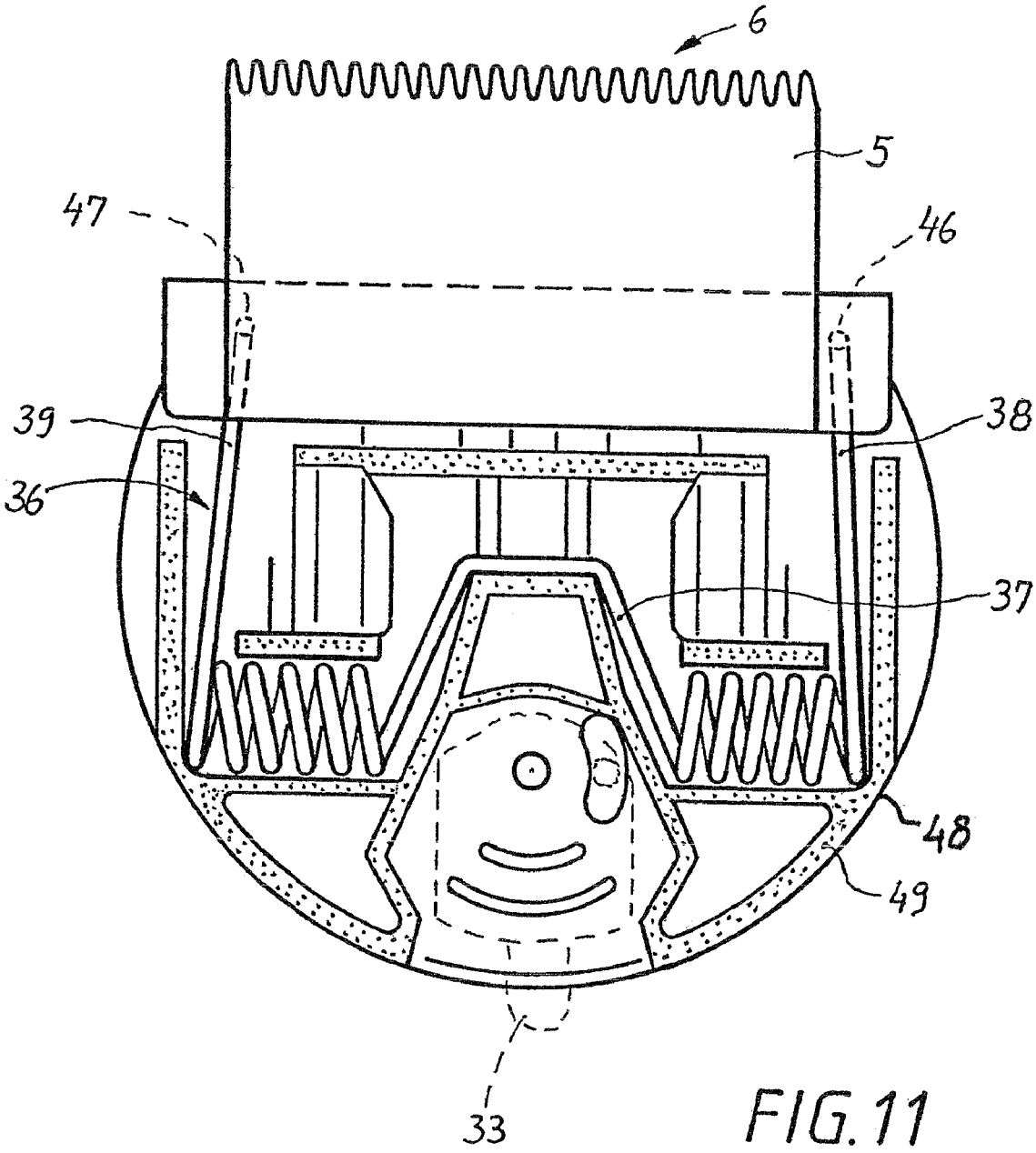
FIG. 11, a plan view on the cutting head, with a parallel guide of the cutting blade.

FIG. 11 shows a plan view of the cutting head 1 with the lower and upper shearing blades 2, 3 and the stationary eccentric part 42 removed, to make a spring 37 more clearly visible. The lever 33 for manually adjusting the shearing blades 2, 3 in the direction of the arrow 32 (FIGS. 1, 2) with respect to the cutting blade 5 has been shown in dashed lines in FIG. 11. The cutting blade 5 is guided by a parallel guide 36 by the one-piece, U-shaped spring 37 with two legs 38, 39, and for this purpose the cutting blade 5 is provided with corresponding receptacles 44, 45 for the ends of the legs. The two bores 46, 47 serve to receive the angled ends of the legs 38, 39. The spring 37 is embedded in a carriage 48, so that the cutting blade 5 is capable of moving parallel. For displacing the carriage 48 by the eccentric 13, the carriage 48 has a sliding face 49, represented by the dotted features, which corresponds to a plane face 50 (FIG. 4) of the lower shearing blade 2.

Figure 12:
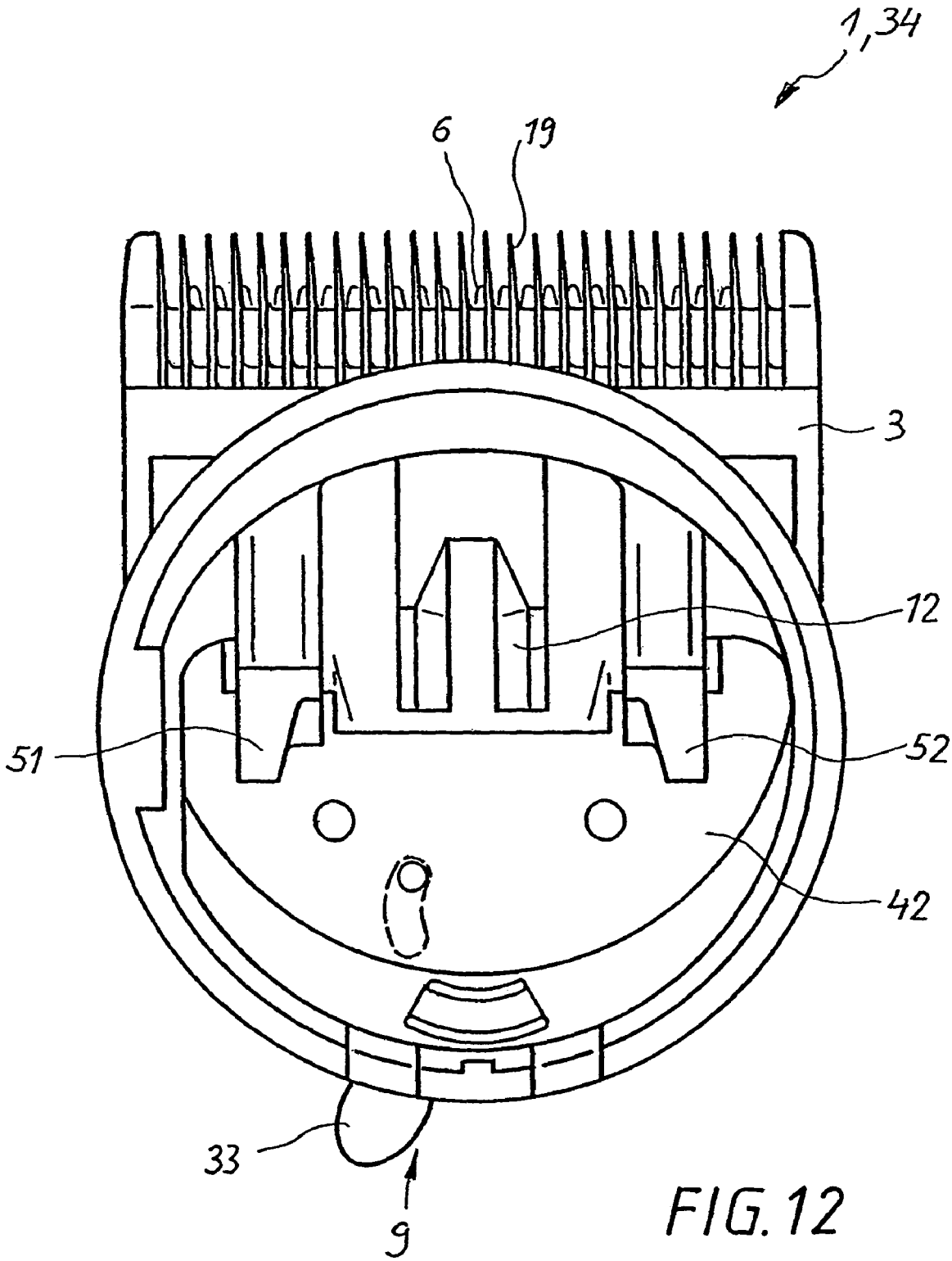
FIG. 12, a back view of the cutting head of FIG. 11.

FIG. 12 shows a back view of the cutting head 1 of FIG. 11, and in this case two detent hooks 51, 52 can be seen, which are joined integrally to the carriage 48 of plastic and serve to lock to the hair cutting machine 4.

Figure 13:
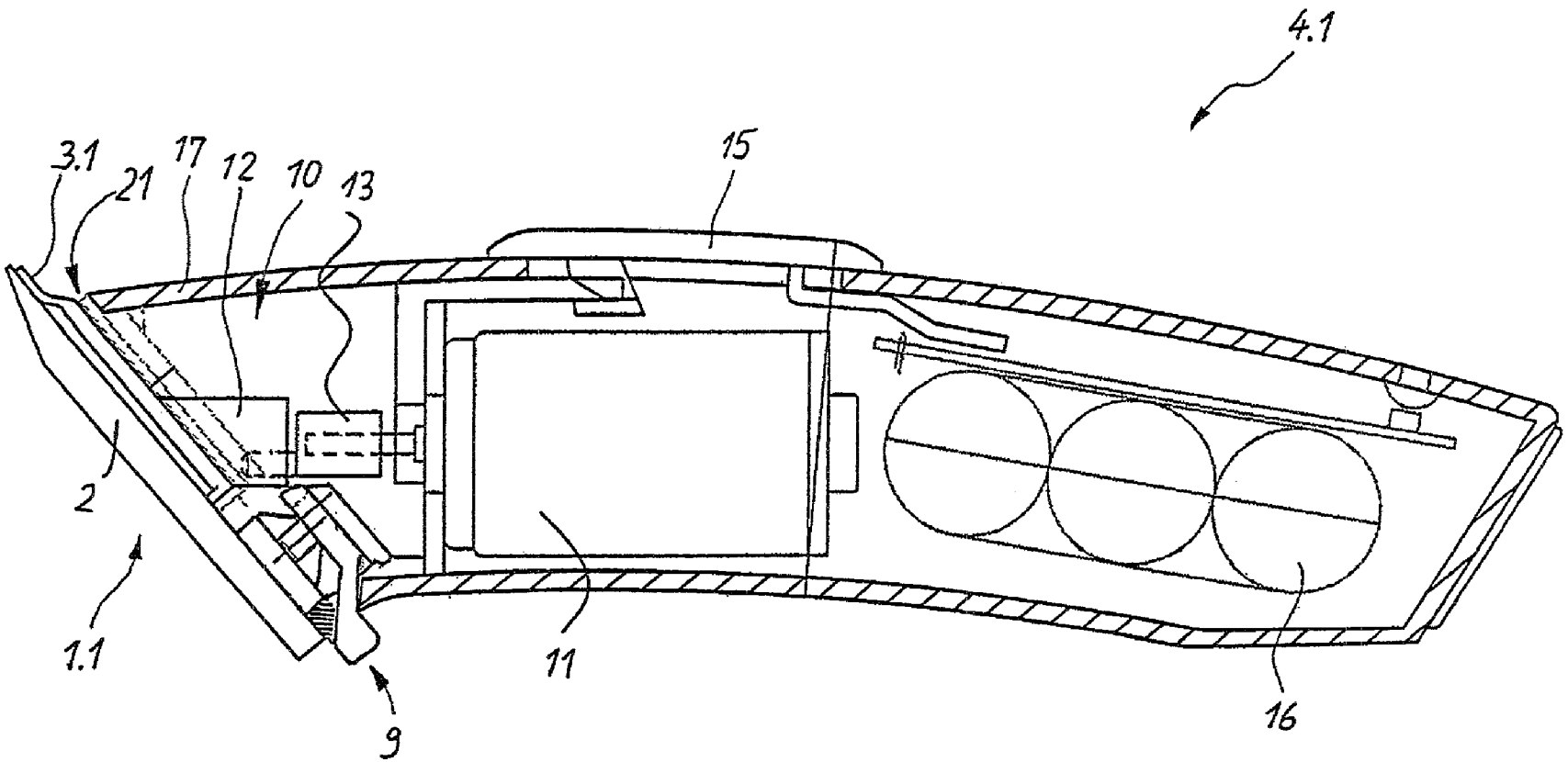
FIG. 13 PRIOR ART
FIG. 13, in a sectional side view, a cutting head of the prior art, which is joined to a hair cutting machine.

FIG. 13—in comparison to FIG. 2—in a sectional side view shows a cutting head 1.1 of the prior art, which is joined to the housing 17 of a hair cutting machine 4.1. It also becomes clear here that a structurally required gap 21 (because of the oscillating upper shearing blade) between the cutting head 1.1 and the housing 17 brings about soiling from fine hair particles in the interstice 10, which is prevented in the exemplary embodiment of FIG. 2.

List of Reference Numerals:

| | |
|---|---|
| 1 | Cutting head |
| 2 | Lower shearing blade |
| 3 | Upper shearing blade |
| 4 | Hair cutting machine |
| 5 | Cutting blade |
| 6 | Cutting serration |
| 7 | Flat material |
| 7.1 | Metal sheet |
| 8 | Lubricant reservoir |
| 9 | Hair cutting length adjuster |
| 10 | Interstice |
| 11 | Drive motor |
| 12 | Slaving device |
| 13 | Eccentric |
| 14 | Eccentric peg |
| 15 | Switch |
| 16 | Rechargeable battery |
| 17 | Housing |
| 18 | Hair |
| 19 | Shearing blade serration |
| 20 | Tooth gap |
| 21 | Gap |
| 31 | Slit |
| 32 | Arrow |
| 33 | Lever |
| 34 | Structural unit |
| 35 | Arrow |
| 36 | Parallel guide |
| 37 | Spring |
| 38, 39 | Leg |
| 40, 41 | Fastening screw |
| 42 | Stationary eccentric part |
| 43 | Connecting rail |
| 44, 45 | Spring leg receptacle |
| 46, 47 | Bore |
| 48 | Carriage |
| 50 | Plane face |
| 51, 52 | Detent hook |
| B | Guide width |
| S | Thickness of cutting blade 5 |

The invention claimed is:

1. A cutting head (1) for an electric hair cutting machine (4), comprising:

one lower shearing blade (2) and one upper shearing blade (3) fixedly joined to one another, wherein each of said lower shearing blade and said upper shearing blade includes a shearing serration;

a slit disposed between said lower shearing blade (2) and said upper shearing blade (3) wherein the shearing serration of the lower shearing blade is separated from the shearing serration of the upper shearing blade;

a cutting blade (5) comprising cutting teeth (6) and made from a flat material (7) having a substantially constant thickness (S) between opposite blade surfaces, the cutting blade configured to be driven in oscillation in opposite cutting directions that are substantially parallel to said blade surfaces, wherein said slit forms a guide that receives the cutting blade (5), wherein the cutting blade (5) is disposed between the lower and upper shearing blades and is configured to oscillate relative to the lower and upper shearing blades (2, 3), wherein said cutting teeth correspond to said shearing serrations on said lower shearing blade and said upper shearing blade and cooperate with said shearing serrations to cut hair, and wherein the thickness (S) of the cutting blade (5) is approximately 0.1 to 1.0 mm; and a hair length cut adjuster (9) configured to adjust the relative positions of the blades by moving the lower shearing blade (2) and the upper shearing blade (3) relative to the cutting blade (5), wherein the lower shearing blade (2) and the upper shearing blade (3) are adjustable relative to the cutting blade (5) in a direction that is substantially parallel to said blade surfaces and perpendicular to the cutting directions.

2. The cutting head as defined by claim 1, wherein the flat material (7) is a hard metal sheet (7.1).

3. The cutting head as defined by claim 1, wherein the cutting blade (5) is provided with a parallel guide (36).

4. The cutting head as defined by claim 1, wherein the cutting head (1) is configured to cooperate with a lubricant reservoir (8).

5. The cutting head as defined by claim 1, wherein the cutting head (5) is in the form of a structural unit (34).

6. The cutting head as defined by claim 5, wherein the cutting head (5) is configured to be lockable to the hair cutting machine (4).

7. The cutting head as defined by claim 1, wherein the cutting blade (5) is configured to be driven to oscillate by a drive motor (11) via a slaving device (12).

8. The cutting head as defined by claim 1, wherein the cutting blade (5) is configured to be driven without a pressure perpendicular to said blade surfaces when the blade is moved.

* * * * *